US010253776B2

(12) United States Patent
Eschner

(10) Patent No.: US 10,253,776 B2
(45) Date of Patent: Apr. 9, 2019

(54) CAN FOR MAGNETICALLY COUPLED PUMPS AND PRODUCTION PROCESS

(71) Applicant: Klaus Union GmbH & Co. KG, Bochum (DE)

(72) Inventor: Thomas Eschner, Bochum (DE)

(73) Assignee: KLAUS UNION GMBH & CO. KG, Bochum (DE)

( * ) Notice: Subject to any disclaimer, the term of this patent is extended or adjusted under 35 U.S.C. 154(b) by 0 days.

(21) Appl. No.: 16/029,018

(22) Filed: Jul. 6, 2018

(65) Prior Publication Data

US 2018/0313353 A1 Nov. 1, 2018

Related U.S. Application Data

(62) Division of application No. 14/650,823, filed as application No. PCT/EP2013/076195 on Dec. 11, 2013.

(30) Foreign Application Priority Data

Dec. 11, 2012 (DE) ..... 10 2012 024 130

(51) Int. Cl.

| | |
|---|---|
| ***F04D 13/02*** | (2006.01) |
| ***F04D 29/02*** | (2006.01) |
| ***C22F 1/10*** | (2006.01) |
| ***C22C 19/05*** | (2006.01) |

(52) U.S. Cl.

CPC ..... *F04D 13/025* (2013.01); *C22C 19/05* (2013.01); *C22C 19/055* (2013.01); *C22F 1/10* (2013.01); *F04D 29/02* (2013.01); *F04D 29/026* (2013.01)

(58) Field of Classification Search

CPC ..... F04D 13/025; F04D 29/02; F04D 29/026; C22F 1/10

See application file for complete search history.

(56) References Cited

U.S. PATENT DOCUMENTS 3,473,922 A * 10/1969 Culling ..... C22C 19/056 420/454

6,605,164 B2 * 8/2003 Kennedy ..... C22C 19/055 148/410

(Continued)

*Primary Examiner* — Patrick Hamo

(74) *Attorney, Agent, or Firm* — Raymond R. Ferrera; Adams and Reese LLp

(57) ABSTRACT

Magnetically coupled pumps use cans which have a side wall arranged in a gap between a driver and a rotor of the pump. With a view to good efficiency of the pump, the gap should be as narrow as possible, which can only be achieved with a side wall of a thin wall thickness. In this case, the can must be of a sufficiently great strength, in particular to withstand the differences in pressure in the pump. At the same time, it must be possible for the can to be shaped into a desired geometry in a simple way and to have a high degree of dimensional stability, even under high pump pressures. It is proposed to make a can (1) with a side wall (3) that consists at least partially of a material with a nickel component, wherein the material is a nickel—chromium alloy comprising at least 50 percent by weight of nickel and 17 to 21 percent by weight of chromium, and to harden the side wall (3) by a heat treatment. This allows a can (1) that is very resistant to corrosion and/or high temperatures to be provided in a simple way.

7 Claims, 2 Drawing Sheets

(56) References Cited

Figure 1:
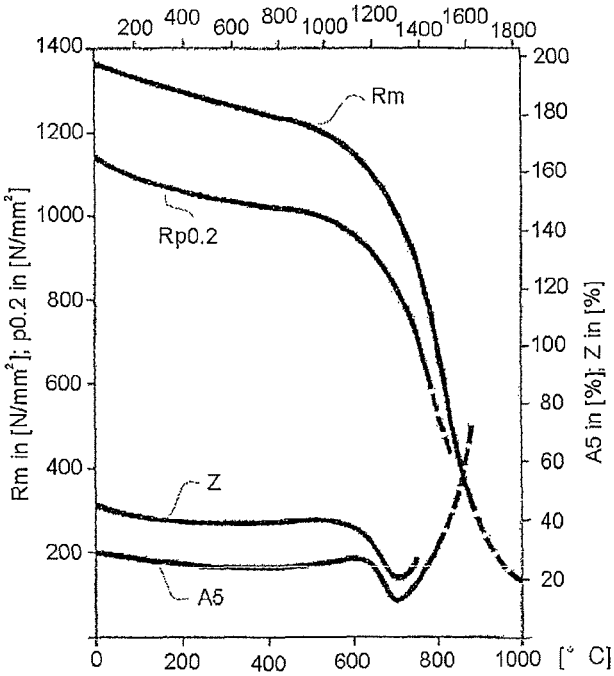

U.S. PATENT DOCUMENTS 6,672,818 B1 * 1/2004 Terracol ..... F04D 29/043
192/84.1
7,789,288 B1 * 9/2010 Johnson ..... B23K 1/0018
228/119

* cited by examiner

CAN FOR MAGNETICALLY COUPLED PUMPS AND PRODUCTION PROCESS

The present invention relates to a can for arrangement in a gap between a driver and a rotor of a magnetically coupled pump, as well as to a process for production of the can.

For delivery of fluids, particularly in chemical industries, high requirements are posed to tightness of delivery lines and pumps in most applications. At the same time, a high degree of efficiency of the pumps must be ensured. Pumps equipped with solely static seals, i.e. pumps without shaft seals, can be built highly impermeable to fluids. Magnetically coupled pumps can be sealed statically by arranging a stationary can between a driver located on the input drive side and a magnetically driven rotor located on the output drive side, and surrounding the rotor. The can is arranged in the magnetic field between driver and rotor, and the magnetic forces are transferred through the can. A pump impeller can be coupled to the rotor. Driver and rotor are provided with permanent magnets and arranged as closely as possible next to each other in order to be able to furnish an efficient drive. The wall thickness of the side wall of the can predetermines how large the distance and/or gap between driver and rotor must be.

Frequently, the distance and thus the width of the air gap formed between driver and rotor just amounts to approx. 4 mm, for example, and then the can has a wall thickness of e.g. 2 mm. A narrow gap and/or a very tight design of the wall thickness of the can with regard to a minimal width of the gap provides advantages in terms of the degree of efficiency, particularly with regard to minimizing drive losses, but it also reduces a safety factor and possibly the service life of the can, too, depending on which fluids are to be delivered. In order to nevertheless be able to realize a gap as narrow as possible, it is of interest to manufacture the can from a particularly high-grade quality material which apart from high strength, high hardness in particular, also has good corrosion resistance. Corrosion resistance is especially important with regard to the least possible wall thickness of the side wall. At the same time, it should also be possible to subject the can to post-treament, particularly to cold forming, in order to be able to adjust the geometry of the side wall by way of forming to processes. Nickel-based alloys have hitherto proved to be a suitable material for cans.

It is the object to provide a can in which apart from good structural material properties it is also possible to ensure high corrosion resistance. It is also an object to build the can in such a manner that it can easily brought into a desired target geometry. Not least is it an object to build a can in such a manner that it can be provided with high material hardness in a simple way.

An inventive can, which for example can be used for arrangement in a gap between a driver and a rotor of a magnetically coupled pump or in a canned motor pump, too, is comprised of:

- a flange part, e.g. for connecting the can with the pump or motor;
- a bottom;
- a side wall which can be arranged in the gap, with the can being in mounted status, said side wall consisting at least partially of a material with a nickel constituent.

The invention proposes that the material is a nickel—chromium alloy which is comprised of at least 50 percent by weight of nickel and 17 to 21 percent by weight of chromium. Hereby, it is feasible to furnish a particularly resistant can.

Preferably, not only part of the side wall is made of this material, but the side wall is entirely made of this material, in particular if the side wall is designed to have a minimal material thickness. Optionally, the entire can may be made of this material, although different, particularly more cost-effective materials may be chosen for the flange part.

Preferably, the material comprises cobalt (Co), and the cobalt portion amounts to maximally 1 percent by weight. Further preferably, the material comprises boron (B), and the boron portion amounts to maximally 0.006 percent by weight.

To be understood as bottom of the can is preferably a section which provides for a pot-like closure of the can at one end, and which thereby merges into the side wall.

To be preferably understood as a flange part of the can is a section which is designed to arrange and fix the can in a defined position and alignment in the pump.

In accordance with a practical example, the material is a nickel—chromium—iron alloy, in particular a nickel alloy designated Alloy 718 (Nicofer 5219 Nb), wherein the nickel portion amounts to maximally 55 percent by weight, and the ferrous portion ranging between 10 and 25 percent by weight. In other words, the present invention relates to the use of a suitable nickel—chromium—iron alloy for a can which is designed for arrangement in a gap between a driver and a rotor of a magnetically coupled pump. Such a material may be a nickel—chromium—iron alloy having high strength and therefore being particularly suitable for cans utilized in pumps operating at high pressures. At the same time, it is well formable in certain conditions, in particular in a solution annealed condition, and therefore it allows for post-treatment in a simple manner, for example by flow-forming. It is furthermore advantageous that hydrogen embrittlement does not occur with this material so that even hydrogenous media can be delivered by a pump equipped with such a can.

Moreover, such a material furnishes the advantage of being hardenable without causing deformation. Hereby, it is possible in a simple manner to provide a high-strength can having high dimensional stability so as to be able to provide for a particularly narrow air gap in the pump. Hardening may be accomplished by performing heat treatment over a predefined period of time and at a predefined temperature at an at least predefined temperature level. For avoidance of stress cracks, a preceding solution annealing is expedient. Solution annealing may preferably be carried out with the following parameters:

- generating a temperature in a furnace in a range of 960° C., particularly 960° C.±15° C., preferably exactly 960° C.;
- annealing the can in the furnace for at least 60 minutes, wherein depending on the wall thickness, the residence time of the can should amount to at least 3 minutes per millimeter of wall thickness;
- quenching, particularly in a water bath, after solution annealing.

Though a number of different solution annealing processes are feasible for is application to this material, particularly in a temperature range from 940 to 1080° C., and though quenching can also be performed in air, it became evident that the afore-described solution annealing process is to be preferred particularly for the side wall.

Hardness measurement is preferably taken before and after heat treatment.

It is recommendable to keep the can free from grease, oil, lubricants or other contaminants before it is subjected to heat treatment.

Adjustment and setting of the material hardness may preferably be performed with the following parameters:

generating in a furnace a temperature in a range of 720° C., particularly 720° C.±8° C., preferably exactly 720° C., wherein this step may comprmise a cooling of the furnace from the temperature for solution annealing to the hardening temperature;

subjecting the can to heat treatment in the furnace for a first residence time of approx. 8 hours, preferably exactly 8 hours at this temperature;

decreasing the temperature in the furnace to approx. 620° C., particularly 620° C.±8° C., preferably exactly 620° C., in particular within a time period of 2 hours and in closed condition of the furnace, with the can staying in the furnace;

subjecting the can in the furnace to heat treatment for a second residence time of approx. 8 hours, preferably exactly 8 hours, at the decreased temperature, with it being possible to optionally extend the second residence time to up to 12 hours, in particular for process engineering related reasons; and cooling in still air.

It may be of importance to bring the furnace to the design temperature for solution annealing before the workpiece is launched into the furnace.

As compared with titanium alloys applied hitherto frequently at high pressures and susceptible to hydrogen embrittlement, a broader field of applications thus results. Besides, the material has a higher hardness as compared to titanium. Furthermore, the material furnishes the advantage of high temperature resistance, in particular up to 600° C.

Such an alloy furnishes hight strength with good residual expansion, that means also sufficient ductility in order to allow for post-treatment. Good formability can be ensured.

The inventive can preferably receives its target geometry by flow-forming of the side wall as a special type of cold forming. By way of flow-forming, the pot part can be furnished with a comparably thin side wall, e.g. in a range of 1 mm, with it also being possible for the wall thickness of the side wall to lie in a narrow tolerance range, in particular with deviations of less than 1/10th. The thin wall thickness, but also the narrow tolerance range, furnish the advantage of a high drive efficiency with a magnetically coupled pumps, because driver and rotor of the pump can be arranged particularly closely next to each other. At the same time, production cost may be kept low, because post-treatment on the side wall of the can is not necessary. The side wall may be manufactured with such a high stability and such a narrow tolerance range that face-turning or grinding or any other shaping process is no longer required. Flow-forming is prerably to be understood to be a cold forming process in which the side wall of the can is brought to a defined thickness and receives a defined alignment, in particular a cylindrical geometry with high dimensional stability, i.e. a slight deviation from the cylindrical shape in radial direction (stability better than 1/10th). Accordingly, flow-forming may lead to an extension of the cylindrical side wall in axial direction without causing a change in the diameter of the can. To be understood as target geometry is a geometry which the can is to assume at the end of the production process, in particular in the area of the side wall and bottom. The target geometry is preferably defined by the relevant wall thickness of the side wall and bottom, an outside diameter, and tolerance ranges for the relevant dimensions. A special advantage furnished by the type of production described above is that the can gets completely along without any weld seams or, in other words, has no pressure-bearing weld seams.

The mechanical properties of the hot-formed and cold-formed material of the inventive can at room temperature in solution annealed condition and after hardening may be defined via tensile strength (Rm) in N/mm$^2$, yield strength (Rp0.2) in N/mm$^2$, elongation at fracture (A5), and constriction (Z) in percent, Brinell hardness in HB, and grain size in μm:

tensile strength in N/mm$^2$: 1240 to 1275;

yield strength in N/mm$^2$: approx. 1035, preferably exactly 1035;

elongation at fracture in percent: 6, 10, 12 or ≥14;

Brinell hardness in HB: ≥331, particularly 341;

grain size in μm: preferably ≤127.

The modulus of elasticity for room temperature may lie, for example, in a range of 205 kN per mm$^2$ and for 100° C. e.g. in a range of 199 kN per mm$^2$.

With special advantage, the material of the inventive can (by way of an appropriate heat treatment) may have an elongation at fracture of ≥14% and a notch impact energy of ≥20 Joule, preferably ≥27 Joule. Thereby, the inventive can fulfills the requirements of the pressure vessel directive (Directive 97/23/EC on Pressure Vessels). This makes the can suitable for application in pumps that operate with an internal overpressure of more than 0.5 bar.

Preferably, the alloy contains a substantial portion of niobium and molybdenum as well as a low portion of aluminum and tinanium. The portions in percent relative to the weight preferably lie within the following ranges, those values indicated in round brackets relating to a variant of the alloy that can be implemented in corrosive media, in particular in media containing $H_2S$, $CO_2$ or Cl. The change in composition in particular relates to the alloy constituents carbon and niobium, but also to aluminum and titanium, with higher carbon and niobium portions furnishing advantages in high-temperature applications, and with lower carbon and niobium portions to be preferred for applications in corrosive media:

nickel between 50 and 55 percent;

chromium between 17 and 21 percent;

molybdenum between 2.8 and 3.3 percent;

niobium between 4.75 and 5.5 percent (niobium and tantalium together between 4.87 and 5.2 percent);

aluminum between 0.2 and 0.8 percent (0.4 and 0.6 percent);

titanium between 0.65 and 1.15 percent (0.8 and 1.15 percent);

a residue of iron.

The ferrous residue preferably lies in a range from 11 to 24.6 percent by weight (12 to 24.13 percent by weight).

The alloy may contain further trace elements, in particular up to 0.08 percent (0.045 Prozent) C, and/or up to 0.35 percent Mn, and/or up to 0.35 percent Si, and/or up to 0.3 percent (0.23 percent) Cu, and/or up to 1.0 percent Co, and/or up to 0.05 percent Ta, and/or up to 0.006 percent B, and/or up to 0.015 percent (0.01 percent) P, and/or up to 0.0015 percent (0.01 percent) S, and/or up to 5 ppm (10 ppm) Pb, and/or up to 3 ppm (5 ppm) Se, and/or up to 0.3 ppm (0.5 ppm) Bi.

Preferably, the portion of carbon lies exactly at 0.08 percent by weight (0.045 percent by weight) or in a range of 75-100% at 0.08 percent by weight (0.045 percent by weight), that means between 0.06 and 0.08 percent by weight (0.03375 and 0.045 percent by weight). Good temperature resistance can hereby be achieved. Optionally, the niobium portion alternatively or additionally lies exactly at 5.5 percent by weight (5.2 percent by weight niobium and tantalium together) or in a range of 5.25 to 5.5 percent by weight (5.1 to 5.2 percent by weight niobium and tantalium together).

In accordance with a variant, the portion of carbon lies at 0.00 percent by weight (0.00 percent by weight) or in a range of 0-25% at 0.08 percent by weight (0.045 percent by weight), that means between 0.00 and 0.02 percent by weight (0.00 and 0.011 percent by weight). Good corrosion resistance can hereby be achieved. Optionally, the portion of niobium alternatively or additionally lies at exactly 4.75 percent by weight (4.87 percent by weight) or in a range of 4.75 to 5.0 percent by weight (4.87 to 4.98 percent by weight niobium and tantalium together).

Such an alloy furnishes the advantage of high temperature resistance up to 700° C. with good strength even in a range of high temperatures. Furthermore, these alloys feature high fatigue strength, good creep strength up to 700° C., and good oxidation resistance up to 1000° C. Likewise, they furnish good mechanical properties at low temperatures and good corrosion resistance at high and low temperatures as well as good resistance to stress corrosion cracking as well as pitting. Corrosion resistance, especially versus stress cracks, can be ensured in particular by the portion of chromium. Therefore, the alloy can also be utilized in media existing in crude oil extraction and crude oil processing, in $H_2S$ laden acid gas environments or in the field of marine engineering.

Accordingly, the specific density of the alloy, for example, lies in a range of 8 g/cm$^3$, particularly it amounts to 8.2 g/cm$^3$.

The fabric of the alloy is austenitic with several phases, in particular with the phases carbides, Laves ([Fe, Cr]2Nb), δ (Ni3Nb) orthorhombic, γ" (Ni3Nb, Al, Ti) space-centered tetragonal structure, and/or γ' (Ni3Al, Nb) face-centered cubic structure. Preferably, in any way, the phase γ" (Ni3Nb, Al, Ti) is available in a space-centered tetragonal structure which can be adjusted by precipitation hardening. The phase γ" (Ni3Nb, AI, Ti) with a space-centered tetragonal structure furnishes good resistance to crack formation due to deformation by ageing.

Production of the alloy can be realized by melting in a vacuum arc induction furnace and a subsequent electroslag refining. Refining (transforming) can also is be effected by a vacuum arc process.

In accordance with a practical example, the material contains molybdenum, with the portion of molybdenum ranging between 2.8 and 3.3 percent by weight. Good corrosion resistance can hereby be achieved, in particular independently of the temperature range in which the can is used.

In accordance with another practical example, the material contains niobium, with the portion of niobium ranging between 4.75 and 5.5 percent by weight, or the material contains niobium and tantalium, with the portion of niobium and tantalium together accounting for 4.87 to 5.2 percent by weight. Good temperature resistance can hereby be adjusted and set. The portion of niobium ensures formation of at least one of the following phases of an austenitic fabric, whereby the advantageous strength values of the material can be ajdusted and set: phase δ (Ni3Nb) orthorhombic, phase γ" (Ni3Nb, Al, Ti) space-centered tetragonal and/or phase γ' (Ni3Al, Nb) face-centered cubic.

In accordance with another practical example, the material contains aluminum and titanium, with the portion of aluminum ranging between 0.2 and 0.8, preferably 0.4 and 0.6 percent by weight and/or the portion of titanium ranging between 0.65 and 1.15, preferably between 0.8 and 1.15 percent by weight. Especially good mechanical properties can hereby be achieved, in particular because aluminum and titanium can ensure formation of at least one of the following phases of an austenitic fabric: phase γ" (Ni3Nb, Al, Ti) space-centered tetragonal, and/or phase γ' (Ni3Al, Nb) face-centered cubic.

In accordance with another practical example, the material is a nickel—chromium—molybdenum alloy, in particular the nickel alloy Hastelloy C-22HS or a variant of this alloy, with the portion of chromium amounting to 21 percent by weight and the portion of nickel amounting to at least 56 percent by weight, in particular to 56.6 percent by weight, and the portion of molybdenum accounting for 17 percent by weight. In other words, the present invention relates to the use of a is suitable nickel—chromium—molybdenum alloy for a can, for example for arrangement in a gap between a driver and a rotor of a magnetically coupled pump or a canned motor pump. Such a material is a nickel—chromium—molybdenum alloy which features high corrosion resistance and high ductility accompanied at the same time by high stiffness and thus form stability and/or dimensional stability in relation to a produced target geometry.

The alloy constituents preferably range at the followinig values in percent by weight:

- nickel as principal constituent in a percentage depending on the percentages of the further constituents, but at least 56.6 percent;
- chromium (Cr): 21 percent;
- molybdenum (Mo): 17 percent;
- iron (Fe): maximally 2 percent;
- cobalt (Co): maximally 1 percent;
- tungsten (W): maximally 1 percent;
- manganese (Mn): maximally 0.8 percent;
- aluminum (Al): maximally 0.5 percent;
- silicon (Si): maximally 0.08 percent;
- carbon (C): maximally 0.01 percent;
- boron (B): maximally 0.006 percent.

Such a material can be hardened in a simple manner after a preceding reshaping. It is of high strength by means of precipitation hardening after cold forming, particularly without intermediate solution annealing. The achievable hardness is a function of the reshaping degree. This furnishes the advantage that for example flow-forming of the side wall of the can may be performed in order to adjust a defined wall thickness, and that hardening of the side wall is performed after flow-forming. Cold forming, in particularly flow-forming is then effected preferably after a solution annealing. Accordingly, the advantages of high dimensional stability and the advantages of high strength can be combined with each other in a simple manner. Furthermore, the material features high acid resistance which makes its use particularly interesting for pumps in chemical industries (chemical pumps).

Preferably, the material contains tungsten which distinguishes it from the nickel—chromium—iron alloy described above.

The strength of the material can be adjusted by heat treatment, in the course of which $Ni_2$(Mo, Cr) particles are formed, with the heat treatment being carried out preferably in a temperature range of 605 to 705° C. However, the good corrosion resistance of the alloy can already be achieved just by way of solution annealling.

Preferably, heat treatment for adjusting a higher hardness is performed with the following parameters:

- heat treatment in a furnace at 705° C., in particular for a duration of 16 hours;

cooling of the furnace to 605° C.;

heat treatment in the furnace at 605° C., in particular for a duration of 32 hours; and quenching in air.

The specific density preferably lies in a range of 8.6 g/cm$^3$ in solution annealed condition or 8.64 g/cm$^3$ in hardened condition.

For example, the modulus of elasticity at room temperature lies in a range of 223 GPa (and/or kN/mm$^2$) and for 100° C. it lies in a range of 218 GPa (and/or kN/mm$^2$). The mechanical properties of the reshaped material at room temperature in solution annealed condition may be defined via tensile strength (Rm) in N/mm$^2$, yield strength (Rp0.2) in N/mm$^2$, elongation at fracture (A5) and constriction (Z) in percent, Brinell hardness in HP, and grain size in μm, the first values relating to cold-formed components and the second values relating to hot-formed components:

tensile strength in Mpa and/or N/mm$^2$: approx. 837 (806);

yield strength in Mpa and/or N/mm$^2$: approx. 439 (376);.

By hardening, the values can be adjusted as follows:

tensile strength in Mpa and/or N/mm$^2$: approx. 1230 (1202);

yield strength in Mpa and/or N/mm$^2$: approx. 759 (690).

The achievable hardnesses lie in the following ranges, depending on the duration of a solution annealing performed prior to hardening, with the hardness values being determined according to Rockwell, either according to Scale B (hardness values in unit Rb) or C (hardness values in unit Rc).

| | Hardness [Rb] or [Rc] | |
|---|---|---|
| Shape of Material | Annealed | Hardened |
| Slab | 92 Rb | 30 Rc |
| Thin-walled plate | 90 Rb | 30 Rc |
| Bar/Rod | 88 Rb | 30 Rc |

For room temperature with a cold-formed side wall of the can depending on the reshaping degree (in percent), the following hardness values of the side wall may be adjusted by way of precipitation hardening:

| Duration of Hardening | Hardness [Rc] as per Reshaping Degree [%] | | | | | |
|---|---|---|---|---|---|---|
| [h] | 0% | 10% | 20% | 30% | 40% | 50% |
| 0 | <20 | 29 | 35 | 37 | 40 | 45 |
| 1 | <20 | 27 | 33 | 38 | 41 | 47 |
| 4 | <20 | 26 | 33 | 39 | 41 | 48 |
| 10 | <20 | 35 | 40 | 41 | 45 | 51 |
| 24 | <20 | 40 | 43 | 44 | 48 | 52 |

As becomes evident from the table above, the achievable hardness depends on the reshaping degree. The higher the reshaping degree, the higher the achievable hardness.

In accordance with another practical example, the material contains iron, with the ferrous portion accounting for maximally 2 percent by weight.

In accordance with another practical example, the side wall is a side wall brought by a reshaping step into a target geometry and having a reshaping degree of over 10 percent, preferably between 20 and 50 percent, in particular 35 percent. A particularly high hardness can be achieved by reshaping and subsequent hardening.

The present invention also relates to a method for manufacturing a can for arrangement in a gap between a driver and a rotor of a magnetically coupled pump, said method comprising the steps of:

forming a flange part of the can for connecting the can with the pump;

forming a bottom of the can;

forming a side wall arrangeable in the gap in mounted condition of the can at least partially from a material containing a nickel constituent, with the side wall being brought by a reshaping step, particularly by flow-forming, into a target geometry.

Inventively chosen as material is a nickel—chromium alloy in a solution annealed condition which contains at least 50 percent by weight of nickel and 17 to 21 percent by weight of chromium, with a hardening by heat treatment being performed after reshaping.

Hardening can optionally be performed directly or after an intermediately executed solution annealing. Hardening is preferably accomplished by heat treatment in a temperature range of 605 to 728° C., in particular for a duration of 18 to 48 hours, with the heat treatment being a two-stage treatment in relation to the chosen temperature and with maintainng one stage each for at least 8 hours.

In accordance with a practical example, reshaping is a cold forming procedure, with a precipitation hardening being performed after cold forming, in particular in a temperature range from 605 to 728° C. and without intermediate solution annealing after cold forming. Cold forming is preferably a flow-forming procedure. Precipitation hardening can optionally be accomplished directly afer cold forming or after an intermediate step for solution annealing. For the nickel—chromium—molybdenum alloy described above, precipitation hardening is preferably executed without the intermediate step of solution annealing. Accordingly, a rising hardness can be achieved with rising hardening times, for example choosing the hardening periods in a range of 1, 4, 10, 24 or 32 hours, preferably 32 hours at 605° C., because due to the longer duration, the hardness Rc as per Rockwell Scale C can be increased by over 10 percent.

Figure 2:
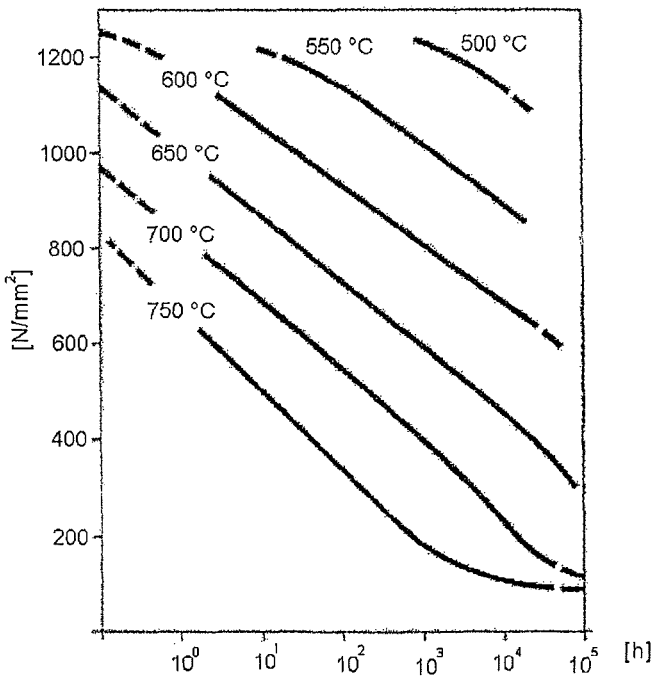
Figure 3:
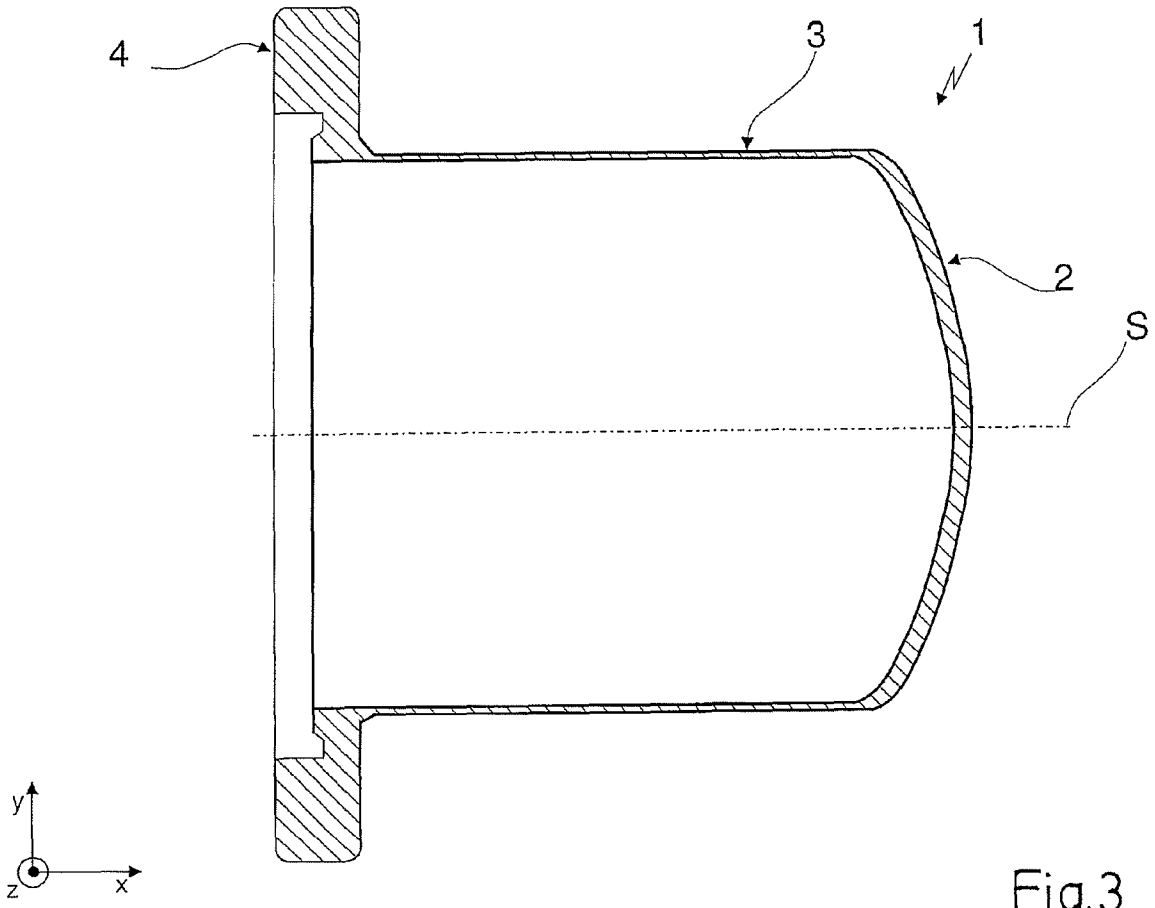

Practical examples of the present invention are described in the following by way of drawings, where:

FIG. 1: shows a diagram on typical short-term properties of an alloy according to a first practical example of the present invention;

FIG. 2: shows a diagram on typical creep strengths of the alloy according to a first practical example of the present invention; and FIG. 3: in a schematic representation shows a can made of material according to the first or second practial example of the present invenion.

FIG. 1 illustrates typical short-term properties of a nickel—chromium—iron alloy in a solution annealed and hardened condition as a function of temperature in ° C. It may be gathered from the diagram that quite constant mechanical properties prevail in a temperature range of room temperature up to 600° C., which applies in particular to elongation at fracture (A5) and constriction (Z), thus furnishing advantages in terms of good dimensional stability of the can.

FIG. 2 shows typical creep strengths of the nickel—chromium—iron alloy in a solution annealed and hardened condition as a function of time in hours, with the time being plotted logarithmically, and with the creep strengths being indicated in N/mm$^2$ on the y-axis. It may be gathered from the diagram that even over a period of $10^5$ hours equivalent to well over 11 years, a loss of mechanical strengths at temperatures below 500° C. is hardly perceptible.

FIG. 3 shows a can 1, which is symmetrically configured in relation to a symmetry axis S, and which comprises a bottom 2, a side wall 3 as well as a flange part 4. Can 1 features a nickel—chromium alloy, hence it is partially or entirely made of a material that may be formed from nickel and chromium and other alloy constituents. A partial construction of the can in this material may for example only relate to the side wall 3. Preferably, at least the side wall 3 is completely made of this material.

LIST OF REFERENCE SYMBOLS

1 Can
2 Bottom
3 Side wall
4 Flange part
S Symmetry axis

The invention claimed is:

1. A separating can (1) comprising:

a flange part (4);

a bottom (2); and a side wall (3) arranged in a gap between a driver and a rotor of a magnetically coupled pump in a mounted status of the can, said side wall consisting at least partially of a material containing a nickel constituent, wherein the material is a nickel—chromium—iron alloy which contains between 50 percent and 55 percent by weight of nickel, between 17 and 21 percent by weight of chromium, between 10 and 25 percent by weight of iron, and between 0.5 and 10 percent by weight of niobium;

further wherein said material has a deformation-free hardenability property;

further wherein said side wall is reshaped into a desired target geometry having a reshaping degree of more than 10 percent.

2. The separating can according to claim 1, wherein the material contains molybdenum ranging between 2.8 and 3.3 percent by weight.

3. A separating can (1) comprising:

a flange part (4);

a bottom (2); and a side wall (3) arranged in a gap between a driver and a rotor of a magnetically coupled pump in a mounted status of the can, said side wall consisting at least partially of a material containing a nickel constituent, wherein the material is a nickel—chromium—iron alloy which contains between 50 percent and 55 percent by weight of nickel, between 17 and 21 percent by weight of chromium, and between 10 and 25 percent by weight of iron; further wherein the material contains niobium and tantalium, with the portion of niobium and tantalium together accounting for between 0.5 and 10 percent by weight;

further wherein said material has a deformation-free hardenability property;

further wherein said side wall is reshaped into a desired target geometry having a reshaping degree of more than 10 percent.

4. The separating can according to claim 1, wherein the material contains aluminum and titanium, with the portion of aluminum ranging between 0.2 and 0.8 percent by weight and the titanium portion ranging between 0.65 and 1.15 percent by weight.

5. A separating can (1) comprising:

a flange part (4);

a bottom (2); and a side wall (3) arranged in a gap between a driver and a rotor of a magnetically coupled pump in a mounted status of the can, said side wall consisting at least partially of a material containing a nickel constituent, wherein the material is a nickel—chromium—molybdenum alloy, with the portion of chromium amounting to 21 percent by weight and the portion of nickel amounting to at least 56 percent by weight, and the molybdenum portion amounting to 17 percent by weight;

further wherein said material has a deformation-free hardenability property;

further wherein said side wall is reshaped into a desired target geometry having a reshaping degree of more than 10 percent.

6. The separating can according to claim 5, wherein the material contains iron, with the iron portion amounting to maximally 2 percent by weight.

7. The separating can according to claim 1, wherein said separating can does not have any pressure-bearing welding seams.

* * * * *